US011952668B2

(12) United States Patent
Umehara et al.

(10) Patent No.: US 11,952,668 B2
(45) Date of Patent: Apr. 9, 2024

(54) CARBURIZED PART AND METHOD FOR MANUFACTURING SAME

(71) Applicant: NIPPON STEEL CORPORATION, Tokyo (JP)

(72) Inventors: Miyuri Umehara, Tokyo (JP); Shingo Yamasaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 493 days.

(21) Appl. No.: 17/414,178

(22) PCT Filed: Mar. 29, 2019

(86) PCT No.: PCT/JP2019/014388
§ 371 (c)(1),
(2) Date: Jun. 15, 2021

(87) PCT Pub. No.: WO2020/202406
PCT Pub. Date: Oct. 8, 2020

(65) Prior Publication Data

US 2022/0042156 A1 Feb. 10, 2022

(51) Int. Cl.

| | |
|---|---|
| ***C23C 8/22*** | (2006.01) |
| ***C21D 1/06*** | (2006.01) |
| ***C21D 9/32*** | (2006.01) |
| ***C22C 38/00*** | (2006.01) |
| ***C22C 38/02*** | (2006.01) |
| ***C22C 38/06*** | (2006.01) |
| ***C22C 38/58*** | (2006.01) |
| ***C22C 38/60*** | (2006.01) |

(52) U.S. Cl.
CPC ..... *C23C 8/22* (2013.01); *C21D 1/06* (2013.01); *C21D 9/32* (2013.01); *C22C 38/001* (2013.01); *C22C 38/02* (2013.01); *C22C 38/06* (2013.01); *C22C 38/58* (2013.01); *C22C 38/60* (2013.01)

(58) Field of Classification Search
CPC .... C23C 8/22; C21D 1/06; C21D 9/32; C22C 38/58
See application file for complete search history.

(56) References Cited

U.S. PATENT DOCUMENTS

| | | | |
|---|---|---|---|
| 2012/0085465 A1 | 4/2012 | Neishi et al. | |
| 2014/0299234 A1 | 10/2014 | Ninomiya et al. | |

FOREIGN PATENT DOCUMENTS

| | | | | |
|---|---|---|---|---|
| CN | 103382538 | * 11/2013 | ..... | C23C 8/22 |
| IN | 988/DEL/2014 A | 6/2015 | | |
| JP | 2007-231305 A | 9/2007 | | |
| JP | 2009-114488 A | 5/2009 | | |
| JP | 2011-6734 A | 1/2011 | | |
| JP | 2016-191151 A | 11/2016 | | |

(Continued)

*Primary Examiner* — Jessee R Roe
(74) *Attorney, Agent, or Firm* — Birch, Stewart, Kolasch & Birch, LLP

(57) ABSTRACT

The present invention provides a method for obtaining a carburized part using steel high in content of Cr and realizing bending fatigue strength at an extremely high level by vacuum carburizing. The carburized part is obtained by treating a steel material having a predetermined chemical composition by vacuum carburizing provided with a carburizing period of 10 to 200 minutes at 850 to 1100° C. and a diffusion period of 15 to 300 minutes at 850 to 1100° C., then quenching and tempering it.

4 Claims, 2 Drawing Sheets

(56) References Cited

FOREIGN PATENT DOCUMENTS

| | | | |
|---|---|---|---|
| JP | 2017-171970 | A | 9/2017 |
| JP | 2018-28130 | A | 2/2018 |
| JP | 6414385 | B2 | 10/2018 |

* cited by examiner

CARBURIZED PART AND METHOD FOR MANUFACTURING SAME

FIELD

The present invention relates to a carburized part reduced in grain boundary cementite in a carburized portion after carburizing and quenching, and to a method for manufacturing a carburized part.

BACKGROUND

In the process of manufacturing transmission parts for automotive use, surface hardening is performed for the purpose of improving the bending fatigue strength and pitting strength etc. In recent years, from the viewpoint of improving the fuel efficiency of automobiles, transmission parts are being required to be made smaller in size and lighter in weight through improvement of the above-mentioned strengths.

For example, when manufacturing gears, as the means for surface hardening, gas carburizing and quenching is generally employed. It is known that, at the time of gas carburizing, a grain boundary oxide layer is formed at the surface of the steel material, pearlite and other incompletely hardened structures are formed, and the various strengths relating to gears fall due to these phenomena. For this reason, steels reduced in the oxidizing elements of Si, Mn, and Cr have been proposed, but with just adjustment of these alloying elements, major improvement of the bending fatigue strength and pitting strength is difficult.

On the other hand, when employing vacuum carburizing and quenching instead of gas carburizing and quenching, there are the advantages that 1) not only is a grain boundary oxide layer seen at the surface of the steel material, but it is also possible to avoid a reduction in various types of strength compared with gas carburizing and 2) high temperature carburizing is possible, so the treatment time can be shortened compared with gas carburizing.

In PTLs 1 and 2, carburized parts obtained by vacuum carburizing of steel materials given Cr contents in the steel materials of 0.29% or less to keep cementite from precipitating at the edge parts along with vacuum carburizing and given Mn contents of 1.40% or more to secure hardenability are disclosed.

However, if carburizing the SCM420 of JIS standard steels generally widely used as case hardened steel by vacuum carburizing, sometimes bending fatigue strength of the same extent and pitting fatigue life of the same degree as SCM420 carburized by gas carburizing results. The reason is as follows:

If making C penetrate at the time of carburizing, carbides are formed. The carbides formed at that time are made to dissolve at the time of diffusion. However, it is not possible to make all of the carbides produced at the time of carburizing dissolve at the time of diffusion. For this reason, part of the carbides remain. This being so, the remaining carbides become starting points for fatigue fracture. To keep down this fatigue fracture in advance and promote longer service life, it is sufficient to make the carbides produced at the time of carburizing sufficiently dissolve at the diffusion period.

As means for suppressing the formation of carbides after vacuum carburizing and quenching, and improving the strength of parts, various methods have been proposed up to now. For example, In PTL 3, the art of making Si %+Ni %+Cu %−Cr % a value higher than 0.3 to suppress formation of carbides in the carburizing period, suppress carbides after carburizing and quenching, and improve the rolling fatigue life is described.

In PTL 4, as steel for vacuum carburizing use enabling a bending fatigue strength and pitting strength of the same extents as or better than the case when using SCM822H as the steel material even when not containing much Ni, Mo at all and provided with excellent workability, steel for vacuum carburizing use controlling the balance of contents of Mn and S is disclosed.

CITATIONS LIST

Patent Literature

[PTL 1] Japanese Unexamined Patent Publication No. 2018-28130

[PTL 2] Japanese Unexamined Patent Publication No. 2016-191151

[PTL 3] Japanese Unexamined Patent Publication No. 2009-114488

[PTL 4] Japanese Unexamined Patent Publication No. 2011-6734

SUMMARY

Technical Problem

In PTLs 3 and 4, the time, temperature, and other conditions of the carburizing period and diffusion period in the vacuum carburizing are not controlled. For this reason, in the case where the carburizing temperature is high or the case where the carburizing time is long, the concentration of carbon at the surface of the steel material becomes higher, so sometimes the coarse cementite formed along the grain boundaries fail to sufficient dissolve at the time of diffusion and the bending fatigue strength falls.

The present invention was made in consideration of the above situation and has as its object the provision of a vacuum carburized part using steel with a high Cr content and realizing bending fatigue strength at an extremely high level. Further, the present invention has as its object the provision simultaneously of a method for manufacturing a vacuum carburized part enabling such a vacuum carburized part to be obtained.

Solution to Problem

The inventors engaged in intensive research to solve this problem and as a result discovered the following: Below, these findings will be explained in detail while referring to FIG. 1 to FIG. 2.

Note that, FIG. 1 is a schematic view for explaining a thermal cycle in vacuum and quenching, hardening and tempering performed in the method for manufacturing a vacuum carburized part according to the present invention. FIG. 1(*a*) shows the case where quenching is performed right after the end of the diffusion period. FIG. 1(*b*) shows the case where the part is held for a certain duration after the end of the diffusion period, then quenched. FIG. 2 is a photograph showing one example of the surface structure at a machine part obtained at the stage after the above vacuum carburizing and quenching, and tempering. No grain boundary cementite or incompletely hardened structures are formed and the microstructure becomes uniform.

The inventors obtained the findings that by treating a vacuum carburized part by the vacuum carburizing shown in FIG. 1, it is possible to raise the concentration of C in the steel at a region of a depth down to 1.5 mm from the surface of the vacuum carburized part, it is possible to make the Vickers hardness at a region of a depth down to 0.10 mm from the surface of the vacuum carburized part 700 HV or more, and it is possible to make the Vickers hardness at the position of a depth of 1.5 mm or more from the surface of the vacuum carburized part 200 to 400 HV.

Further, the inventors obtained the finding that by treating a vacuum carburized part by the vacuum carburizing shown in FIG. 1, as shown in FIG. 2, a grain boundary cementite fraction of a flat part at a region of a depth down to 0.10 mm from the surface of the vacuum carburized part is 0.5% or less and the incompletely hardened structures can be kept down to 0.5% or less.

In addition, the inventors obtained the finding that by raising the concentration of C, raising the hardness, reducing the grain boundary cementite fraction, and reducing the incompletely hardened structures explained above, it is possible to improve the bending fatigue strength of a vacuum carburized part.

The present invention was obtained based on the above findings and was obtained as a result of further detailed study. It has as its gist the following:

(1) A carburized part, a chemical composition in a region of a depth of 1.5 mm or more from a surface of the carburized part containing, by mass %, C: 0.10 to 0.40%, Si: 0.10 to 3.00%, Mn: 0.50 to 3.00%, Cr: 0.30 to 3.00%, Al: 0.010 to 0.050%, N: 0.003 to 0.030%, S: 0.003 to 0.030%, P: 0.030% or less, Mo: 0 to 3.00%, B: 0 to 0.0050%, Nb: 0 to 0.100%, Ti: 0 to 0.100%, V: 0 to 0.30%, Ni: 0 to 0.40%, In: 0 to 0.02%, Cu: 0 to 0.20%, Bi: 0 to 0.300%, Pb: 0 to 0.50%, REMs: 0 to 0.020% and a balance of Fe and impurities; a Vickers hardness at a depth of 1.5 mm from the surface being 200 to 400 HV; a content of C at a region of a depth down to 0.10 mm from the surface being, by mass %, 0.60 to 1.20%; a fraction of hardened structures of an area ratio being 99.00% or more; a grain boundary cementite fraction of an area ratio being 0.50% or less; a fraction of incompletely hardened structures of an area ratio of 0.50% or less.

(2) The carburized part of the above (1) wherein a Vickers hardness of a depth of 0.10 mm from the surface is 700 HV or more.

(3) A method of manufacture for manufacturing the carburized part of the above (1) or (2) comprising the steps of: shaping into the shape of a machine part a steel material having a chemical composition in a region of a depth of 1.5 mm or more from the surface as described in the above (1), vacuum carburizing the shaped steel material, cooling the vacuum carburized steel material by a cooling rate of 10° C./s or more from a temperature region of 850° C. or more until reaching 200° C., and tempering the cooled steel material at 130 to 200° C.; the process of vacuum carburizing comprising a carburizing period of holding the steel material at 850 to 1100° C. for 10 to 200 minutes and causing carbon to penetrate it in a carburizing gas atmosphere and a diffusion period of stopping the supply of carburizing gas and holding the steel material at (a) 850 to 970° C. for 50 to 300 minutes or (b) over 970 to 1100° C. for 15 to 300 minutes.

(4) The method for manufacture of the carburized part of the above (3) further comprising, in the carburizing period, holding the steel material in a carburizing gas atmosphere at (c) 850 to 970° C. for 50 to 200 minutes or (d) over 970 to 1100° C. for 10 to 200 minutes.

Advantageous Effects of Invention

In the art relating to the vacuum carburized part according to the present invention, the constituents of the steel material, the carburizing temperature, the diffusion temperature, and the diffusion time are made to change to reduce the grain boundary cementite and incompletely hardened structures at the flat part at a region of a depth down to 0.10 mm from the surface of the vacuum carburized part.

Therefore, according to the art relating to the vacuum carburized part according to the present invention, it is possible to obtain a vacuum carburized part with an extremely high bending fatigue strength.

DESCRIPTION OF EMBODIMENTS

Figure 1:
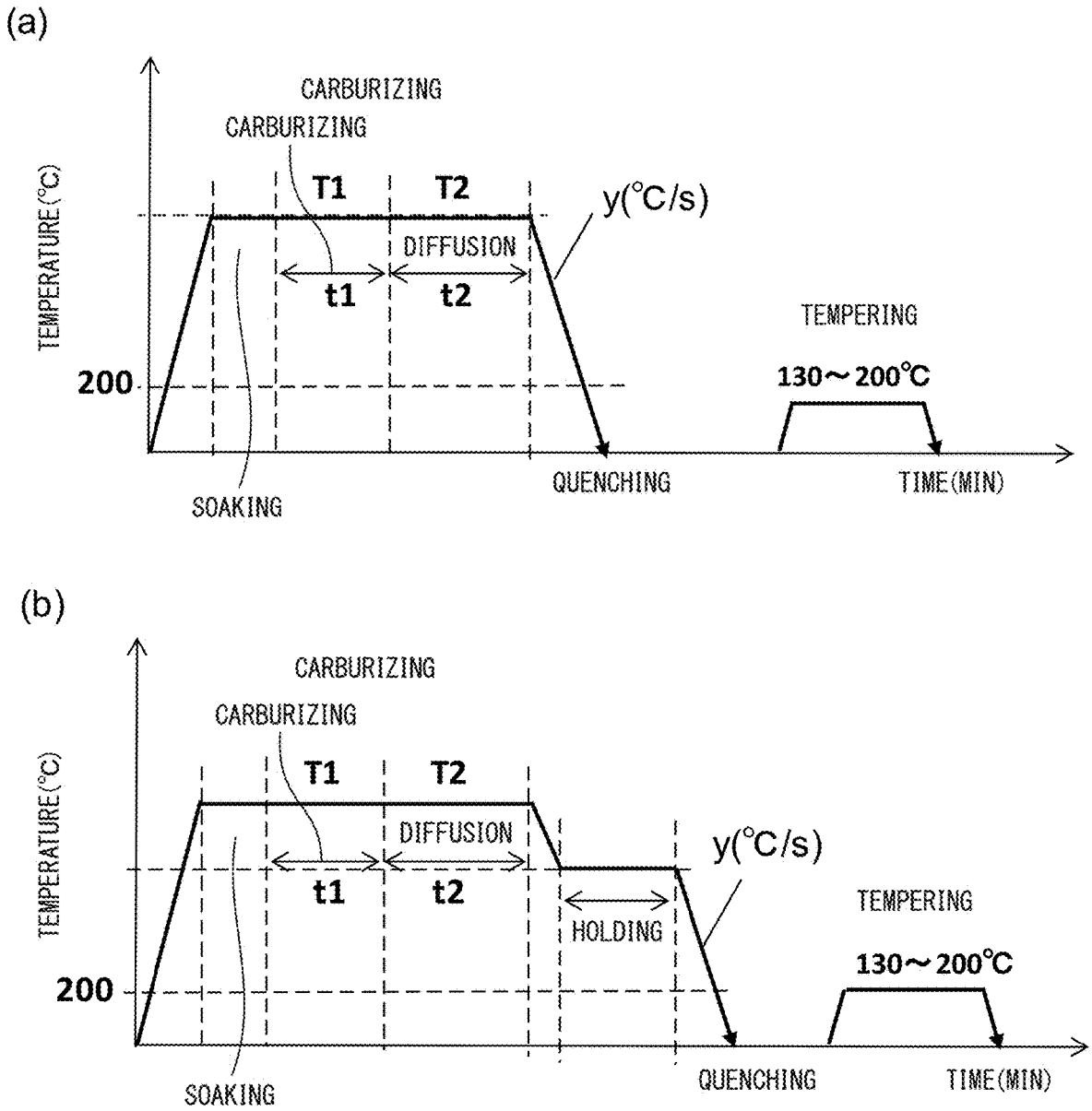
FIG. 1 is a schematic view for explaining a thermal cycle in vacuum carburizing and quenching, and tempering performed in the method for manufacturing a vacuum carburized part according to the present invention.
Figure 2:
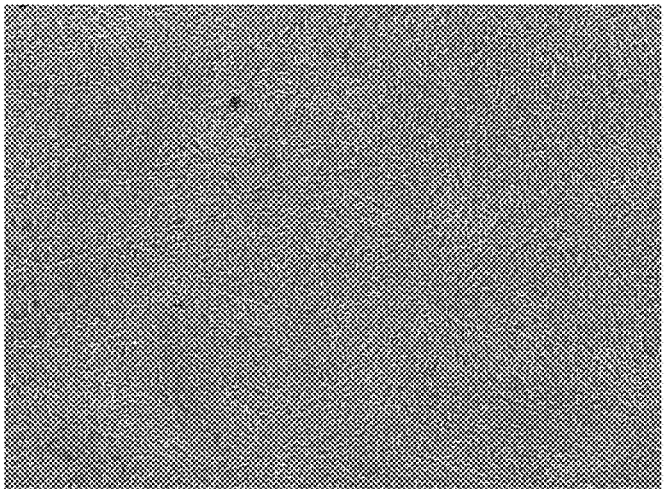
FIG. 2 is a photo showing one example of the microstructure of a surface layer of a flat part of a machine part obtained at a stage after the above vacuum carburizing and quenching, and tempering.

Below, the various constituent requirements of the vacuum carburized part and method for manufacturing the vacuum carburized part of the present invention will be explained in detail. Note that, below, the "%" of the contents of the elements mean "mass %".

Vacuum Carburized Part

First, the vacuum carburized part of the present invention will be explained in detail. Here, the "vacuum carburized part" means a part receiving a bending stress. The reasons for limitation of the chemical composition of the steel of the material are as follows:

Constituent Elements

The chemical composition of the vacuum carburized part of the present invention is as follows below: However, the "chemical composition" referred to here means the constituent elements at the region of a depth of 1.5 mm or more from the surface of the vacuum carburized part (core). It does not mean the constituent elements at a region of a depth of less than 1.5 mm from the surface.

Essential Elements

C: 0.10 to 0.40%

C is an element for obtaining the strength required as a machine part. If the content of C is less than 0.10%, the strength required as a machine part cannot be obtained. On the other hand, if the content of C is more than 0.40%, the toughness of the steel deteriorates and further the hardness of the material rises resulting in the fatigue strength remarkably deteriorating. Therefore, the amount of C is made 0.10 to 0.40%.

To obtain the effect of improvement of the strength and the prevention of deterioration of the fatigue strength due to deterioration of the toughness at a further higher level, the amount of C is preferably 0.15% or more and preferably 0.30% or less.

Si: 0.10 to 3.00%

Si is an element suppressing the movement of coarse cementite from the ε carbides precipitating at the time of tempering and making the temper softening resistance of low temperature tempered martensite steel remarkably increase. To obtain this effect, the content of Si has to be made 0.10% or more. On the other hand, if including Si in more than 3.00%, not only does the effect of increasing the temper softening resistance become saturated, but also, due to the rise in the hardness of the material, the fatigue strength remarkably deteriorates. Therefore, the amount of Si is made 0.10 to 3.00%.

To obtain prevention of deterioration of the fatigue strength of the steel at a higher level, the amount of Si is preferably 0.20% or more and preferably 2.00% or less.

Mn: 0.50 to 3.00%

Mn is an element effective for raising the hardenability of steel. To obtain martensite structures, the content of Mn has to be made 0.50% or more. On the other hand, if the amount of addition of Mn is more than 3.00%, the toughness of the steel deteriorates and furthermore the fatigue properties remarkably deteriorate due to the rise in hardness of the material. Therefore, the amount of Mn is made 0.50 to 3.00%.

To more efficiently obtain martensite and prevent deterioration of the fatigue properties at a higher level, the amount of Mn is preferably 0.70% or more and preferably 2.00% or less.

Cr: 0.30 to 3.00%

Cr is an element effective for raising the hardenability of steel. If the content of Cr is less than 0.30%, the effect of improvement of the hardenability cannot be obtained. On the other hand, if the content of Cr is over 3.00%, cementite is formed with priority at the grain boundaries (grain boundary cementite) whereby fatigue cracking occurs earlier and the fatigue properties remarkably deteriorate. Furthermore, Cr concentrates in the cementite and stabilizes there, whereby the alloying constituents in the surroundings become insufficient and incompletely hardened structures are formed. Therefore, the amount of Cr is made 0.30 to 3.00%.

To obtain the effect of improvement of the hardenability etc. and the effect of prevention of cementite and incompletely hardened structures at a further higher level, the amount of Cr is preferably 0.90% or more and preferably 2.00% or less.

Al: 0.010 to 0.050%

Al is an element bonding with N to form AlN and suppressing coarsening of the crystal grains in the austenite region. To suppress coarsening of crystal grains, the content of Al has to be made 0.010% or more. However, if excessively containing Al, the Al forms coarse oxides and easily remains resulting in a drop in the fatigue properties. Therefore, the amount of Al is made 0.010 to 0.050%.

To obtain the effect of suppressing coarsening of the crystal grains and the effect of suppressing a drop in the fatigue properties at a further higher level, the amount of Al is preferably 0.020% or more and preferably 0.040% or less.

N: 0.003 to 0.030%

N is an element bonding with Al to form AlN and suppressing coarsening of the crystal grains in the austenite region. To suppress coarsening of crystal grains, the content of N has to be made 0.0030% or more. However, if excessively containing N, coarse AlN and coarse BN are formed, whereby the base metal becomes remarkably brittle and the fatigue strength remarkably deteriorates. Therefore, the content of N is made 0.003 to 0.030%.

To obtain the effect of suppressing coarsening of the crystal grains and the effect of suppressing a drop in the fatigue properties at a further higher level, the amount of N is preferably 0.005% or more and preferably 0.030% or less.

S: 0.003 to 0.030%

S is an element securing machinability in manufacture of a machine part. However, S bonds with Mn to form MnS. This MnS forms paths for propagation of fatigue cracking due to which the fatigue strength and toughness are made to fall. For this reason, if excessively containing S, the base metal becomes remarkably brittle, the fatigue strength remarkably deteriorates, and the toughness also deteriorates. Therefore, the content of S is made 0.003 to 0.030%.

To obtain the effect of suppressing deterioration of the fatigue strength and the effect of suppressing deterioration of the toughness at a further higher level, the amount of S is preferably 0.005% or more and preferably 0.020% or less.

P: 0.030% or less

P segregates at the austenite grain boundaries to cause the prior austenite grain boundaries to become brittle and thereby causes grain boundary cracking, so is desirably reduced as much as possible. For this reason, the amount of P has to be restricted to 0.030% or less. Therefore, the content of P is made 0.030% or less. Note that, there is no particular need to set a lower limit for the amount of P in solving the problem of the present invention. The amount of P may also be 0. However, if trying to restrict the amount of P to less than 0.001%, the costs swell. The lower limit when considering the costs is 0.001%.

Balance

The balance is comprised of Fe and impurities. "Impurities" indicate elements mixed in from the raw materials of ore and scrap, the manufacturing environment, etc. at the time of industrially manufacturing ferrous iron materials. Further, as impurities, As, Co, O, etc. may be mentioned. Furthermore, Mg, Zr, Te, Sn, Ca, W, Sb, Ta, Zn, etc. may be mentioned. These elements are restricted to extents not detracting from the effects of the present invention.

Note that, O forms $Al_2O_3$, $SiO_2$, and other oxides. These oxides become paths for propagation of fatigue cracking and cause the fatigue strength and toughness to fall. Therefore, it is critical that the content of O as an impurity be decreased as much as possible. The preferable content of O is 0.005% or less, more preferably 0.002% or less.

Further, Sn and Te, which are known as elements improving machinability, have little effect on the fatigue strength and toughness even if respectively contained in 0.01% or less.

Optional Selective Elements

Mo: 0 to 3.00%

Mo is an element causing the hardenability to rise and raising the temper softening resistance. This effect is obtained even if containing Mo in a small amount, but to obtain this effect at a higher level, the content is preferably made 0.05% or more. There is no particular need to set an upper limit for the amount of Mo in solving the problem of the present invention, but if including Mo in 3.00% or more, not only does the effect on hardenability etc. become saturated, but also the manufacturing costs swell. Therefore, the content of Mo is 0 to 3.00%.

B: 0 to 0.0050%

B is an element which raises the hardenability of steel even dissolved just slightly in the austenite, so enables martensite structures to be efficiently obtained at the time of carburizing and quenching. This effect is obtained even if containing B in a small amount, but to obtain this effect at a higher level, the content is preferably made 0.0005% or more. On the other hand, even if adding more than 0.0050% of B, a large amount of BN is formed thereby consuming the N, so the austenite grains coarsen. Therefore, the content of B is 0 to 0.0050%.

Nb: 0 to 0.100%

Nb is an element bonding with N and C in the steel to form carbonitrides. These carbonitrides pin the austenite grain boundaries and in turn suppress grain growth to prevent coarsening of the structures. To obtain the effect of prevention of coarsening of structures, Nb may be included in 0.100% or less. This effect is obtained even if containing Nb in a small amount, but to obtain this effect at a higher level, the content is preferably made 0.005% or more. On the other hand, even if including more than 0.100% of Nb, due to the rise in hardness of the material, the machineability, forgeability, and other workability of the machine part remarkably deteriorate. Further, if including more than 0.100% of Nb, carbonitrides are formed in large amounts and uneven hardness results in the hardened regions at the time of carburizing and quenching. Furthermore, if including Nb in large amounts, the ductility in the 1000° C. or more high temperature region falls and the yield in continuous casting and rolling falls. Therefore, the content of Nb is 0 to 0.100%.

Ti: 0 to 0.100%

Ti is an element bonding with N and C in the steel to form carbonitrides. These carbonitrides pin the austenite grain boundaries and in turn suppress grain growth to prevent coarsening of the structures. To obtain the effect of prevention of coarsening of structures, Ti may be included in 0.100% or less. This effect is obtained even if containing Ti in a small amount, but to obtain this effect at a higher level, the content is preferably made 0.005% or more. On the other hand, even if including more than 0.100% of Ti, due to the rise in hardness of the material, the machineability, forgeability, and other workability of the machine part remarkably deteriorate. Further, if including more than 0.100% of Ti, carbonitrides are formed in large amounts and uneven hardness results in the hardened regions at the time of carburizing and quenching. Therefore, the content of Ti is 0 to 0.100%.

V: 0 to 0.30%

V is an element bonding with N and C in the steel to form carbonitrides. These carbonitrides pin the austenite grain boundaries and in turn suppress grain growth to refine the structures. Further, carbonitrides containing V invite precipitation strengthening and in turn result in an increase in internal hardness. This effect is obtained even if containing V in a small amount, but to obtain this effect at a higher level, the content is preferably made 0.01% or more. On the other hand, if adding more than 0.30% of V, the costs become excessive and due to the rise in hardness of the material, the machineability, forgeability, and other workability of the machine part remarkably deteriorate. Therefore, the content of V is 0 to 0.30%.

Ni: 0 to 0.40%

Ni is an element suppressing excessive carburizing of steel. Ni further raises the toughness of steel and raises the low cycle bending fatigue strength. This effect is obtained even if containing Ni in a small amount, but to obtain this effect at a higher level, the content is preferably made 0.10% or more. Even if including Ni in more than 0.40%, this effect becomes saturated and the manufacturing costs just rise. Therefore, the content of Ni is 0 to 0.40%.

In: 0 to 0.02%

In is an element concentrating at the surface layer and keeping down the drop in the amount of C of the surface layer. This effect is obtained even if containing In in a small amount, but to obtain this effect at a higher level, the content is preferably made 0.01% or more. Even if including more than 0.02% of In, this constituent segregates in the steel and the properties of the carburized part fall. Therefore, the content of In is 0 to 0.02%.

Cu: 0 to 0.20%

Cu is an element suppressing excessive carburizing of steel. Cu further raises the toughness of steel. This effect is obtained even if containing Cu in a small amount, but to obtain this effect at a higher level, the content is preferably made 0.05% or more. Even if including more than 0.20% of Cu, this effect becomes saturated and the manufacturing costs just rise. Therefore, the content of Cu is 0 to 0.20%.

Bi: 0 to 0.300%

Bi is an element raising the machinability of steel. This effect is obtained even if containing Bi in a small amount, but to obtain this effect at a higher level, the content is preferably made 0.005% or more. Even if including more than 0.300% of Bi, this effect becomes saturated and the manufacturing costs just rise. Therefore, the content of Bi is 0 to 0.300%.

Pb: 0 to 0.50%

Pb is an element raising the machinability of steel. This effect is obtained even if containing Pb in a small amount, but to obtain this effect at a higher level, the content is preferably made 0.03% or more. Even if including more than 0.50% of Pb, this effect becomes saturated and the manufacturing costs just rise. Therefore, the content of Pb is 0 to 0.50%.

REMs: 0 to 0.020%

"REMs (rare earth metals)" is the general term for the 15 elements from the atomic number 57 lanthanum to the atomic number 71 ruthenium, the atomic number 21 scandium, and the atomic number 39 yttrium, the total 17 elements. If REMs are contained in steel, at the time of rolling and the time of hot forging, stretching of the MnS particles is suppressed. This effect is obtained even if containing REMs in a small amount, but to obtain this effect at a higher level, the content is preferably made 0.005% or more. However, if the content of REMs is more than 0.020%, sulfides containing REMs are formed in large amounts and the machinability of the steel deteriorates. Therefore, the content of REMs is 0 to 0.020%.

Hardness and Metallic Structure Etc.

Next, the hardness and metallic structure etc. of the vacuum carburized part of the present invention will be explained.

In general, when manufacturing a gear or other machine part subjected to a high surface pressure, to impart good bending fatigue properties, pitting resistance, and wear resistance, the steel material is treated to harden the surface after being worked into the shape of the part.

In the machine part according to the present invention, vacuum carburizing is performed as surface hardening treatment. The machine part obtained through the vacuum carburizing according to the present invention can be raised in bending fatigue properties compared with machine parts obtained through usual vacuum carburizing.

Steel Constituents and Microstructure at Region of Depth Down to 0.10 mm from Surface (Surface Layer)

In the vacuum carburized part of the present invention, the region of a depth down to 0.10 mm from the surface (surface layer) is carburized. The steel constituents and amount of C in the region of a depth of 1.5 mm or more from the surface differ.

In the vacuum carburized part of the present invention, the content of C at a region of a depth down to 0.10 mm from the surface (surface layer) is 0.60% or more and 1.20% or less. Due to this, a high hardness is obtained and fatigue cracking is suppressed, whereby an effect of improvement of the bending fatigue strength is exhibited. The chemical composition of other than C may be made the ranges of contents of the elements in the region of a depth of 1.5 mm or more from the surface of the above-mentioned vacuum carburized part. If within the above ranges, the contents in the region of a depth of 1.5 mm or more from the surface and the contents of the surface layer may differ.

To raise the bending fatigue properties compared with a normal vacuum carburized part, it is critical to make the microstructure of the carburized part in the region of a depth down to 0.10 mm from the surface an area ratio of the grain boundary cementite fraction of 0.50% or less and of the incompletely hardened structures of 0.50% or less. If the grain boundary cementite is more than 0.50% or the incompletely hardened structures are more than 0.50%, these become sources of occurrence of fatigue cracking and the bending fatigue strength falls. "Incompletely hardened structures" indicate ferrite and pearlite.

In the microstructure of the region of a depth down to 0.10 mm from the surface, the hardened structures of the tempered martensite, retained austenite, and bainite account for 99.00% or more of the structures. Due to this, high hardness is obtained and the bending fatigue strength is secured.

Hardness at Depth of 0.10 mm from Surface

Further, in the vacuum carburized part of the present invention, the Vickers hardness at the surface layer can be made 700 HV or more. Due to this, fatigue cracking is suppressed and an effect of improvement of the bending fatigue strength is exhibited. The Vickers hardness of the surface layer is the average value at five points of the hardnesses at a position of a depth of 0.10 mm from the surface measured by a method based on JIS Z 2244 (2009) at a measurement stress of 2.94 N. The distance between centers of recesses of indentations formed by pushing in an indenter was made 3 times or more of the average diagonal line lengths of the recesses.

Note that, the microstructure after tempering was measured by examining a cross-section of the vacuum carburized part parallel to the surface and at a depth down to 0.10 mm from that surface. At the time of measurement, a sample was cut out to enable examination of a cross-section vertical to the surface of the part, then the cross-section was mirror polished, dipped in a mixed solution of nitric acid and alcohol (nitric acid 1.5 ml to alcohol 100 ml) at ordinary temperature for 5 seconds to corrode it, then immediately rinsed with water. After that, the region of a depth down to 0.10 mm (100 μm) from the surface as continuously examined.

For the examination, a scanning electron microscope (SEM) set to a power of 5000× was used to obtain an image of a width 10×depth 100 μm range. Image analysis was used to find the total area ratios of the grain boundary cementite and incompletely hardened structures. The ratios of the grain boundary cementite and incompletely hardened structures with respect to the total area ratio of the observed field were expressed as percentages to obtain the grain boundary cementite fraction and fraction of incompletely hardened structures. Here, the grain boundary cementite and incompletely hardened structures which were covered in the examination were made ones with circumscribed circle equivalent diameters of 200 nm or more. Grain boundary cementite and incompletely hardened structures smaller than that have little effect on the bending fatigue strength, so are not included in the total area ratio.

Note that, in analyzing an image acquired by an SEM so as to obtain fractions of the structures, grain boundary cementite and incompletely hardened structures can be easily discriminated from other structures by persons skilled in the art. As examples of specific indicators, the following may be employed.

Grain boundary cementite: Structures formed along grain boundaries

Incompletely hardened structures: Structures corresponding to later explained ferrite or pearlite Pearlite: Structures inside of which lamellar structures distinctive to pearlite structure are seen Ferrite: Structures which are spherical and inside of which lamellar structures or lath structures cannot be seen Alternatively, it is possible to exclude hardened structures (tempered martensite, retained austenite, and bainite) or grain boundary cementite parts from the acquired image and identify remaining regions as "incompletely hardened structures".

Hardness at 1.5 mm Depth from Surface (Core)

In the vacuum carburized part of the present invention, the Vickers hardness at a depth of 1.5 mm from the surface is 200 to 400 HV. If the hardness of the core is insufficient, the fatigue strength and bending fatigue strength of the internal starting points become lower. For this reason, the hardness of the deep part has to be made 200 HV or more. On the other hand, if the hardness of the core is excessively high, the toughness of the machine part becomes lower. Therefore, the hardness of the core is 200 to 400 HV. Note that, if the Vickers hardness of the core is 250 or more, the bending fatigue strength becomes further higher, so this is preferable. Further, if the Vickers hardness at the core is 350 HV or less, it is possible to secure the toughness at a further higher level.

For measurement of the Vickers hardness, hardnesses at positions of depths of 1.5 mm from the carbided surface were measured based on JIS Z 2244 (2009) by loads of 2.94 N at five points and the average value was obtained. The distance between centers of recesses of indentations formed by pushing in an indenter was made 3 times or more of the average diagonal line lengths of the recesses.

As shown above, in the vacuum carburized part of the present invention, the metallic structure and hardness of the surface layer are suitably controlled. In particular, in the metallic structure, by reducing the area ratios of the grain boundary cementite and incompletely hardened structures, the effect is obtained of suppressing fatigue cracking at the surface layer and a high bending fatigue resistance can be obtained.

Method for Manufacturing Machine Part

Next, the method for manufacturing the vacuum carburized part of the present invention will be explained in detail. Here, the method for manufacturing a vacuum carburized part is the method for manufacturing the vacuum carburized part explained above and includes a process of shaping a steel material comprised of predetermined constituents into the shape of a vacuum carburized part (shaping process), a process of carburizing this in a vacuum to adjust an amount of carbon and steel material structure at the surface layer (vacuum carburizing process), a process of quenching this from 850° C. or more in temperature (quenching process), and a process of tempering this at a predetermined temperature (tempering process). Below, the above-mentioned processes will be explained in detail.

Shaping Process

The method for shaping the machine part is not particularly limited. For example, a steel material containing, by mass %, C: 0.10 to 0.40%, Si: 0.10 to 3.00%, Mn: 0.50 to 3.00%, Cr: 0.30 to 3.00%, Al: 0.010 to 0.050%, N: 0.003 to 0.030%, S: 0.003 to 0.030%, and P: 0.001 to 0.030% and having a balance of Fe and impurities is shaped into the form of the machine part. The steel material may also contain, in addition to the above constituents, by mass %, one or more of Mo: 0 to 3.00%, B: 0 to 0.0050%, Nb: 0 to 0.100%, Ti: 0 to 0.100%, V: 0 to 0.30%, Ni: 0 to 0.40%, In: 0 to 0.02%, Cu: 0 to 0.20%, Bi: 0 to 0.300%, Pb: 0 to 0.50%, and REMs: 0 to 0.020%.

As the methods for working the steel material into the predetermined shape of the machine part, hot forging, cold forging, and turning, milling, centering, drilling, screwing, reamer finishing, gear cutting, planing, vertical cutting, broaching, and gear machining, and other cutting, grinding, honing finishing, super finishing, lapping finishing, barrel finishing, liquid honing, and other grinding and electrodischarge machining, electrolytic machining, electron beam machining, laser machining, and additive machining (stacking forming) and other special processing etc. may be mentioned. For example, it is possible to obtain a shaped member of a gear shape from the steel material by the above processing methods.

Vacuum Carburizing Process

After the shaping process, the shaped member is vacuum carburized at a carburizing temperature of 850 to 1100° C. The vacuum carburizing is treatment necessary and essential for suppressing the formation of a grain boundary oxide layer at the surface layer part of the shaped member (region of depth down to 0.10 mm from surface) while hardening the surface of the shaped member and securing the bending fatigue properties required as a machine part.

Vacuum carburizing is treatment utilizing the diffusion phenomenon including a carburizing period for making carbon penetrate the steel in a carburizing gas atmosphere and a diffusion period for stopping the supply of carburizing gas and making the carbon diffuse into the steel. Acetylene, propane, ethylene, and other hydrocarbon gases are used. With a carburizing temperature of less than 850° C., a long duration of heat treatment is required for making sufficient carbon diffuse into the machine part and the costs swell. On the other hand, if the carburizing temperature exceeds 1100° C., remarkable grain coarsening and grain mixing occur. For this reason, the carburizing is performed at 850 to 1100° C. in temperature region. To realize lowering of costs, suppression of grain coarsening, and suppression of mixed grains at a further higher level, this is preferably performed at a carburizing temperature of 900 to 1050° C. in temperature region.

Here, the reasons for employing vacuum carburizing in the present invention are as follows.

1) No grain boundary oxide layer is formed on the surface layer of the shaped member. Compared with gas carburizing, a higher fatigue strength can be obtained.

2) Carburizing at a high temperature becomes possible, so compared with gas carburizing, the treatment time can be shortened.

As explained above, the carburized part of the present invention contains Cr in 0.30% or more. Due to this, it is possible to raise the hardenability of steel. However, if vacuum carburizing steel containing Cr in a high concentration, it is necessary to specially design the carburizing conditions. The reason is as follows:

Vacuum carburizing comprises a combination of a carburizing period for introducing carbon to the surface of the shaped member (steel) and a diffusion period for making carbon diffuse from the surface of the shaped member to the inside of the shaped member. By the combination of the carburizing period and diffusion period, the concentration of carbon is raised from the surface to the inside of the shaped member.

In the carburizing period, the concentration of carbon rises up to several % (in the present invention, 2 to 10% or so) at the surface of the shaped member and grain boundary cementite and other carbides are formed. The carbides formed in the carburizing period dissolve in the steel due to diffusion of carbon in the diffusion period. Carbides precipitate with priority at the crystal grain boundaries, so if carbides remain without sufficiently dissolving, the remaining carbides will cause embrittlement of the grain boundaries and act as starting points for fatigue fracture. Therefore, the carbides have to be made to sufficiently dissolve.

In this regard, Cr has the property of easily concentrating in the cementite. The diffusion rate of the Cr concentrated at the cementite is slow. Cementite in which a large amount of Cr has concentrated falls in rate of dissolution in the steel. Therefore, in the case of steel containing a large amount of Cr, compared with steel with a small amount of Cr, it is difficult to make the carbides formed in the carburizing period sufficiently dissolve and cementite and other carbides easily remain in the diffusion period.

To make carbides sufficiently dissolve and decrease the carbides remaining after vacuum carburizing in steel containing Cr in a high concentration, it is necessary to make the time of the diffusion period longer. Below, the carburizing conditions of the present invention will be explained.

In the carburizing period introducing carbon to the surface of the shaped member, the shaped member is held at 850 to 1100° C. for 10 minutes to 200 minutes. If making the carburizing period less than 10 minutes, sufficient carbon is not supplied to the surface of the shaped member and its inside and the target surface layer hardness cannot be obtained. On the other hand, if making the carburizing period over 200 minutes, the concentration of carbon at the surface of the shaped member becomes excessively high and coarse grain boundary cementite is formed. This is not broken down in the diffusion period and becomes starting points for fatigue fracture. Further, due to concentration of alloying elements in the cementite, the alloying constituents in the surrounding structures become insufficient and the incompletely hardened structures of ferrite and pearlite are formed. These become starting points of fatigue fracture. Note that, to reduce the grain boundary cementite and incompletely hardened structures, it is preferable to make the treatment time 10 minutes to 150 minutes.

Further, if performing carburizing at the relatively low temperature of 850 to 970° C. in temperature region, to cause sufficient diffusion of carbon, the duration of the carburizing period is preferably made 50 to 200 minutes. On the other hand, if performing carburizing at the relatively high temperature of over 970 to 1100° C. in temperature region, sufficient diffusion of carbon can be caused by making the duration of the carburizing period 10 to 200 minutes. That is, the holding conditions in the carburizing period may be made (i) 50 to 200 minutes at 850 to 970° C. or (ii) 10 to 200 minutes at more than 970 to 1100° C.

In the diffusion period stopping the supply of gas and making carbon diffuse from the surface of the shaped member to the inside of the shaped member, sufficient time has to be taken for breaking down the carbides formed in the immediately preceding carburizing period (grain boundary cementite). If performing the carburizing at the relatively low temperature of 850 to 970° C. in temperature region, to sufficiently break down the grain boundary cementite, the diffusion period must be made a duration of 50 to 300 minutes. On the other hand, if performing the carburizing at the relatively high temperature of more than 970° C. to 1100° C. in temperature region, it is possible to sufficiently break down the grain boundary cementite by making the diffusion period a duration of 15 to 300 minutes. That is, it is necessary to make the holding conditions in the diffusion period (iii) 50 to 300 minutes at 850 to 970° C. or (iv) 15 to 300 minutes at more than 970 to 1100° C.

If making the diffusion period a shorter duration than the above conditions, the grain boundary cementite precipitated on the prior austenite grain boundaries at the flat part of the shaped member during the carburizing period cannot be sufficiently broken down and remains even after tempering to thereby form starting points of fracture. Further, due to the concentration of alloying elements in the cementite, the alloying constituents in the surrounding structures become insufficient, the incompletely hardened structures of ferrite and pearlite are formed, and these become starting points of fatigue fracture. On the other hand, if making the diffusion period more than 300 minutes, carbon proceeds to be diffused to the inside of the part whereby the concentration of carbon at the region of a depth of 0.10 mm from the surface of the part falls and the surface layer hardness falls, resulting in a drop in the performance of the part. Note that, to decrease the grain boundary cementite and incompletely hardened structures as targeted, the above treatment time is preferably made 70 to 250 minutes at 850 to 970° C. in the above (iii) or 25 minutes to 250 minutes at more than 970 to 1100° C. in the above (iv).

Holding after End of Diffusion Period

After the end of the diffusion period, the shaped member may be held at a predetermined temperature, then quenched. The purpose of holding the member for a certain time after the end of the diffusion period is to decrease quench cracking and strain at the time of quenching. The holding temperature is made 10 minutes or more at 850° C. or more so as to efficiently make C diffuse. On the other hand, even if holding the shaped member at more than 900° C. for more than 60 minutes, the effect of preventing quench cracking and reducing strain at the time of quenching becomes saturated.

Quenching Process

In the vacuum carburizing, the steel member is quenched right after the end of the diffusion period or right after the end of the holding period following the diffusion period. Quenching is performed to render the structures of the surface layer martensite and improve the hardness. Further, at the time of quenching, the cooling rate from the 850° C. or more temperature region until reaching 200° C. is preferably 10° C./s or more. The reason why 10° C./s or more is preferable is that it is possible to prevent cementite and other carbides from precipitating at the prior austenite grain boundaries during cooling. The cooling rate is more preferably 20° C./s or more. The quenching method is preferably oil quenching which is excellent in cooling properties. Quenching by water is also possible. Further, if the part is small, quenching by high pressure inert gas is also possible.

Tempering Process

After the above quenching ends, the member is tempered at 130 to 200° C. If making the tempering temperature 130° C. or more, it is possible to obtain tempered martensite with a high toughness. Further, by making the tempering temperature 200° C. or less, it is possible to prevent a drop in hardness due to the tempering. Note that, to obtain these effects at respectively further higher levels, the tempering temperature is preferably made 150 to 180° C. By going through this tempering process, the vacuum carburized part according to the present invention is obtained.

As explained above, the method for manufacturing a vacuum carburized part of the present invention includes a shaping process, a vacuum carburizing process, a quenching process, and a tempering process. In particular, it is a method rendering the various heating conditions in the vacuum carburizing process predetermined ranges. Due to this, the surface layer hardness of the obtained vacuum carburized part is raised and the grain boundary cementite fraction is made 0.50% or less and, further, the incompletely hardened structures are made 0.50% or less. As a result, according to the present method for manufacture, it is possible to obtain a vacuum carburized part having excellent bending fatigue properties.

EXAMPLES

Next, examples of the present invention will be explained, but the conditions used in the examples are just illustrations of conditions employed for confirming the workability and advantageous effects of the present invention. The present invention is not limited to this illustration of conditions. The present invention can employ various conditions insofar as not deviating from its gist and achieving its object.

Steels having the chemical compositions shown in Table 1 (Steels A to AM) were melted then hot forged to shape them into 40φ steel rods. Note that the blank fields in Table 1 mean the respective elements were not added. Further, in Table 1, the underlined numerical values indicate values outside the ranges of the present invention.

TABLE 1

| | Chemical composition (mass %) | | | | | | | | | | | | | | |
|---|---|---|---|---|---|---|---|---|---|---|---|---|---|---|---|
| Steel | C | Si | Mn | Cr | Al | N | P | S | Mo | V | B | Nb | Ti | REMs | Others |
| A | 0.20 | 0.20 | 0.80 | 1.10 | 0.025 | 0.010 | 0.0100 | 0.010 | — | — | — | — | — | — | |
| B | 0.12 | 0.25 | 1.00 | 1.00 | 0.011 | 0.025 | 0.0010 | 0.010 | 0.20 | 0.30 | — | — | — | — | Ni: 0.18 |
| C | 0.25 | 0.12 | 1.20 | 0.60 | 0.031 | 0.013 | 0.0012 | 0.004 | 0.20 | — | — | 0.090 | — | — | |
| D | 0.20 | 2.90 | 0.81 | 0.95 | 0.015 | 0.018 | 0.0250 | 0.010 | — | 0.10 | — | — | — | — | In: 0.01 |
| E | 0.20 | 0.20 | 0.61 | 1.05 | 0.020 | 0.010 | 0.0080 | 0.010 | 0.23 | — | — | — | — | — | |
| F | 0.27 | 0.17 | 2.85 | 1.20 | 0.030 | 0.010 | 0.0100 | 0.013 | 0.40 | — | — | 0.020 | — | — | Cu: 0.10 |
| G | 0.25 | 0.76 | 1.76 | 0.35 | 0.010 | 0.007 | 0.0090 | 0.025 | 1.06 | — | — | — | 0.080 | — | Bi: 0.009 |
| H | 0.31 | 0.40 | 1.30 | 2.95 | 0.048 | 0.024 | 0.0100 | 0.010 | 0.10 | 0.30 | 0.0040 | — | 0.002 | — | Pb: 0.15 |
| I | 0.38 | 0.70 | 1.50 | 2.13 | 0.029 | 0.005 | 0.0014 | 0.014 | — | — | 0.0050 | — | — | 0.020 | |
| AA | 0.05 | 0.25 | 0.80 | 1.00 | 0.020 | 0.008 | 0.0260 | 0.010 | — | — | — | — | — | — | |
| AB | 0.45 | 0.30 | 0.60 | 1.10 | 0.010 | 0.010 | 0.0100 | 0.012 | 0.30 | — | — | — | — | — | |
| AC | 0.20 | 0.06 | 0.60 | 0.72 | 0.020 | 0.010 | 0.0110 | 0.020 | 0.20 | 0.30 | 0.0020 | — | — | — | |
| AD | 0.30 | 3.20 | 1.00 | 0.50 | 0.025 | 0.020 | 0.0100 | 0.010 | — | — | 0.0050 | — | 0.050 | — | |

TABLE 1-continued

| Steel | Chemical composition (mass %) | | | | | | | | | | | | | | |
|---|---|---|---|---|---|---|---|---|---|---|---|---|---|---|---|
| | C | Si | Mn | Cr | Al | N | P | S | Mo | V | B | Nb | Ti | REMs | Others |
| AE | 0.30 | 0.30 | 0.45 | 0.60 | 0.017 | 0.012 | 0.0150 | 0.011 | — | — | — | 0.050 | — | — | |
| AF | 0.25 | 1.00 | 3.20 | 0.35 | 0.010 | 0.015 | 0.0130 | 0.010 | 0.40 | — | — | — | — | 0.010 | |
| AG | 0.34 | 0.50 | 0.60 | 0.03 | 0.040 | 0.020 | 0.0180 | 0.015 | 0.10 | 0.10 | 0.0010 | — | 0.020 | — | |
| AH | 0.20 | 0.20 | 1.30 | 3.10 | 0.021 | 0.013 | 0.0100 | 0.010 | — | — | 0.0020 | — | 0.010 | — | |
| AI | 0.15 | 1.30 | 0.60 | 1.68 | 0.080 | 0.025 | 0.0150 | 0.015 | — | — | — | — | — | — | |
| AJ | 0.17 | 0.20 | 0.70 | 0.30 | 0.015 | 0.002 | 0.0150 | 0.015 | | — | 0.0030 | — | — | — | |
| AK | 0.31 | 0.44 | 0.80 | 0.53 | 0.040 | 0.032 | 0.0100 | 0.010 | 1.00 | — | — | — | — | 0.020 | |
| AL | 0.18 | 0.30 | 0.60 | 1.10 | 0.025 | 0.020 | 0.0100 | 0.040 | 0.30 | — | — | — | — | — | |
| AM | 0.20 | 0.15 | 0.85 | 1.00 | 0.005 | 0.010 | 0.0100 | 0.010 | — | — | — | — | — | — | |

Next, from the obtained steel rods, Ono-type rotating bending test pieces of φ12 mm×80 mm with 10 mmR semicircular notches at the centers were prepared by machining. Furthermore, from the obtained steel bars, φ10 mm×50 mm rod test pieces were prepared.

The above Ono-type rotating bending test pieces were treated by vacuum carburizing. They were treated by vacuum carburizing under the conditions shown in Table 2-1 (some test pieces were treated by gas carburizing) and quenched by oil. After that, they were tempered under conditions of 180° C.×120 minutes. Note that the types of gas and flow rates shown in Table 2-1 are general conditions of vacuum carburizing and gas carburizing.

To improve the test precision after tempering, finish processing was applied to the grip parts of the Ono-type rotating bending test pieces.

The Ono-type rotating bending fatigue test was performed based on JIS Z2274 (1978). It was performed at a speed of 3000 rpm for a maximum of 10 million cycles. An S—N graph was prepared to find the rotating bending fatigue limit. Test pieces with rotating bending fatigue limits not reaching 500 MPa (corresponding to SCM420 carburized part) were judged inferior in bending fatigue strength.

The center parts in the length directions of the rod test pieces of the different test levels treated by vacuum carburizing and tempering were cut vertical to the length directions. The Vickers hardnesses at positions of depths of 0.10 mm from the surface layers on the cross-sections were measured at five points by a method based on JIS Z 2244 (2009). The average values were defined as the hardnesses of the surface layers. The measurement stress was made 2.94 N. Further, the Vickers hardnesses at positions of depths of 1.5 mm from the surface layers on the cross-sections were similarly measured at five points and the average values were defined as the hardnesses of the cores.

After the end of the carburizing period, center parts of the rod test pieces of the different test levels which were hardened were cut, the cross-sections were polished, then in the same way as above, the test pieces were dipped in a mixed solution of nitric acid and alcohol (nitric acid 1.5 ml with respect to alcohol 100 ml) for 5 seconds, then continuously examined from the surfaces down to depths of 0.10 mm by an SEM to find the area ratios of carbides in the observed ranges.

The center parts of the rod test pieces of the different test levels which were vacuum carburized and tempered were cut, the cross-sections were polished, then the test pieces were dipped in a mixed solution of nitric acid and alcohol (nitric acid 1.5 ml with respect to alcohol 100 ml) for 5 seconds, then continuously examined from the surfaces down to depths of 0.10 mm to find the respective total area ratios of grain boundary cementite and incompletely hardened structures in the observed ranges.

These evaluation results are shown in Table 2-1 and Table 2-2. The underlined numerical values in Table 2-1 and Table 2-2 show values outside the ranges of the present invention. Note that while not clearly indicated in Table 2-2, the hardened structure fraction at the surface layer becomes 100.00% minus the grain boundary cementite fraction and fraction of incompletely hardened structures.

TABLE 2-1

| Mfg. no. | Steel | Carburizing conditions | | | | | | | | |
|---|---|---|---|---|---|---|---|---|---|---|
| | | Method | Gas | Flow rate (L/min) | Carburizing period T1 (° C.) | Carburizing period t1 (min) | Diffusion period T2 (° C.) | Diffusion period t2 (min) | Quenching ° C. | Cooling y (° C./s) |
| 1 | A | Vac. carb. | Acetylene | 5 | 950 | 70 | 950 | 130 | 860 | 42 |
| 2 | A | Vac. carb. | Acetylene | 10 | 1050 | 15 | 1050 | 50 | 860 | 40 |
| 3 | B | Vac. carb. | Acetylene | 5 | 850 | 125 | 850 | 270 | 850 | 70 |
| 4 | C | Vac. carb. | Propane | 5 | 950 | 50 | 930 | 130 | 870 | 41 |
| 5 | D | Vac. carb. | Acetylene | 10 | 980 | 100 | 980 | 180 | 850 | 44 |
| 6 | E | Vac. carb. | Acetylene | 5 | 930 | 75 | 930 | 130 | 930 | 35 |
| 7 | F | Vac. carb. | Acetylene | 5 | 1000 | 60 | 1000 | 120 | 880 | 65 |
| 8 | G | Vac. carb. | Acetylene | 5 | 930 | 60 | 930 | 145 | 860 | 40 |
| 9 | H | Vac. carb. | Acetylene | 5 | 930 | 90 | 930 | 200 | 930 | 48 |
| 10 | I | Vac. carb. | Acetylene | 10 | 1080 | 10 | 1080 | 40 | 860 | 48 |
| 11 | AA | Vac. carb. | Acetylene | 5 | 930 | 50 | 930 | 130 | 930 | 44 |
| 12 | AB | Vac. carb. | Acetylene | 5 | 930 | 80 | 930 | 150 | 930 | 41 |
| 13 | AC | Vac. carb. | Propane | 5 | 930 | 100 | 930 | 170 | 850 | 38 |
| 14 | AD | Vac. carb. | Acetylene | 5 | 950 | 80 | 950 | 120 | 880 | 48 |

TABLE 2-1-continued

| | | Carburizing conditions | | | | | | | | |
|---|---|---|---|---|---|---|---|---|---|---|
| | | | | | Carburizing period | | Diffusion period | | | Cooling |
| Mfg. no. | Steel | Method | Gas | Flow rate (L/min) | T1 (° C.) | t1 (min) | T2 (° C.) | t2 (min) | Quenching ° C. | y (° C./s) |
| 15 | AE | Vac. carb. | Acetylene | 5 | 950 | 90 | 950 | 140 | 870 | 43 |
| 16 | AF | Vac. carb. | Acetylene | 5 | 950 | 90 | 950 | 120 | 870 | 40 |
| 17 | AG | Vac. carb. | Acetylene | 5 | 1000 | 25 | 1000 | 60 | 860 | 40 |
| 18 | AH | Vac. carb. | Acetylene | 5 | 930 | 50 | 930 | 150 | 930 | 38 |
| 19 | AI | Vac. carb. | Acetylene | 5 | 930 | 80 | 930 | 145 | 930 | 48 |
| 20 | AJ | Vac. carb. | Acetylene | 5 | 1000 | 20 | 1000 | 55 | 880 | 46 |
| 21 | AK | Vac. carb. | Acetylene | 5 | 930 | 80 | 930 | 150 | 930 | 40 |
| 22 | AL | Vac. carb. | Acetylene | 10 | 980 | 35 | 980 | 95 | 850 | 40 |
| 23 | A | Gas carb. | Propane | 5 | 930 | 80 | 930 | 55 | 850 | 50 |
| 24 | A | Vac. carb. | Acetylene | 10 | 1120 | 10 | 1120 | 25 | 870 | 50 |
| 25 | A | Vac. carb. | Acetylene | 5 | 1000 | 8 | 1000 | 30 | 880 | 43 |
| 26 | A | Vac. carb. | Acetylene | 5 | 1000 | 220 | 1000 | 250 | 860 | 45 |
| 27 | B | Vac. carb. | Acetylene | 5 | 980 | 14 | 980 | 14 | 860 | 40 |
| 28 | B | Vac. carb. | Acetylene | 5 | 980 | 100 | 980 | 150 | 870 | 4 |
| 29 | B | Vac. carb. | Acetylene | 5 | 930 | 55 | 930 | 310 | 930 | 40 |
| 30 | AM | Vac. carb. | Acetylene | 10 | 1030 | 20 | 1030 | 50 | 860 | 40 |

TABLE 2-2

| | | Region of depth down to 0.10 mm from surface | | | Hardness distribution | | Part performance | |
|---|---|---|---|---|---|---|---|---|
| Mfg. No. | Steel | C (mass %) | Intergranular cementite percentage (%) | Incompletely hardened structures (%) | Surface layer (HV) | Core (HV) | Rotating bending fatigue limit (MPa) | Remarks |
| 1 | A | 0.80 | 0.35 | 0.25 | 730 | 300 | 520 | Inv. ex. |
| 2 | A | 0.82 | 0.41 | 0.28 | 740 | 310 | 510 | Inv. ex. |
| 3 | B | 0.71 | 0.05 | 0.35 | 701 | 210 | 580 | Inv. ex. |
| 4 | C | 0.75 | 0.16 | 0.12 | 710 | 304 | 580 | Inv. ex. |
| 5 | D | 0.84 | 0.18 | 0.35 | 745 | 350 | 590 | Inv. ex. |
| 6 | E | 0.77 | 0.18 | 0.32 | 725 | 296 | 570 | Inv. ex. |
| 7 | F | 0.92 | 0.45 | 0.40 | 763 | 390 | 560 | Inv. ex. |
| 8 | G | 0.85 | 0.10 | 0.05 | 786 | 376 | 630 | Inv. ex. |
| 9 | H | 1.15 | 0.48 | 0.45 | 840 | 395 | 560 | Inv. ex. |
| 10 | I | 1.02 | 0.47 | 0.38 | 810 | 376 | 540 | Inv. ex. |
| 11 | AA | 0.55 | 0.11 | 0.10 | 660 | 190 | 440 | Comp. ex. |
| 12 | AB | 1.22 | 3.60 | 2.00 | 810 | 420 | 470 | Comp. ex. |
| 13 | AC | 0.81 | 0.24 | 0.60 | 680 | 302 | 490 | Comp. ex. |
| 14 | AD | 0.78 | 0.10 | 0.12 | 790 | 409 | 480 | Comp. ex. |
| 15 | AE | 0.65 | 0.25 | 0.52 | 695 | 205 | 450 | Comp. ex. |
| 16 | AF | 0.88 | 0.20 | 0.08 | 803 | 434 | 480 | Comp. ex. |
| 17 | AG | 0.58 | 0.05 | 0.53 | 680 | 310 | 440 | Comp. ex. |
| 18 | AH | 0.90 | 4.00 | 3.40 | 781 | 382 | 410 | Comp. ex. |
| 19 | AI | 0.84 | 0.45 | 0.34 | 720 | 328 | 480 | Comp. ex. |
| 20 | AJ | 0.73 | 0.10 | 0.13 | 715 | 270 | 480 | Comp. ex. |
| 21 | AK | 0.85 | 0.30 | 0.36 | 766 | 297 | 490 | Comp. ex. |
| 22 | AL | 0.82 | 0.33 | 0.20 | 735 | 300 | 480 | Comp. ex. |
| 23 | A | 0.78 | 0.03 | 5.30 | 740 | 298 | 400 | Comp. ex. |
| 24 | A | 1.22 | 1.50 | 1.90 | 822 | 332 | 450 | Comp. ex. |
| 25 | A | 0.56 | 0.08 | 0.06 | 656 | 270 | 460 | Comp. ex. |
| 26 | A | 1.31 | 4.10 | 3.24 | 850 | 430 | 430 | Comp. ex. |
| 27 | B | 0.95 | 1.70 | 1.10 | 825 | 309 | 460 | Comp. ex. |
| 28 | B | 1.05 | 5.00 | 8.00 | 784 | 320 | 400 | Comp. ex. |
| 29 | B | 0.51 | 0.04 | 0.42 | 643 | 345 | 420 | Comp. ex. |
| 30 | AM | 0.88 | 0.37 | 0.2 | 783 | 290 | 490 | Comp. ex. |

The invention examples of Manufacturing Nos. 1 to 10 had chemical compositions in the cores which were within the ranges of the present invention. All of the concentration of carbon at a region of a depth down to 0.10 mm from the surface layer, the grain boundary cementite fraction, incompletely hardened structures, surface hardness, core hardness and rotating bending fatigue limit reached the targets.

On the other hand, Manufacturing No. 11 had an amount of C of the steel constituents of the part core which was insufficient and had a surface hardness and core hardness which failed to reach the targets. As a result, the rotating bending fatigue limit failed to reach the target.

Manufacturing No. 12 had an amount of C of the steel constituents of the part core which was excessive, had a core hardness outside the target range, had a toughness of the steel which deteriorated, and further had grain boundary cementite and incompletely hardened structures produced in excess. As a result, the rotating bending fatigue limit failed to reach the target.

Manufacturing No. 13 had an amount of Si of the steel constituents of the part core which was insufficient and had a total amount of elements for improving hardenability which was small, so hardenability could not be secured, incompletely hardened structures were formed, and the surface hardness failed to reach the target. As a result, the rotating bending fatigue limit failed to reach the target.

Manufacturing No. 14 had an amount of Si of the steel constituents of the part core which was excessive and had a core hardness outside the target range. Due to the rise in core hardness, the toughness of the steel deteriorated. As a result, the rotating bending fatigue limit failed to reach the target.

Manufacturing No. 15 had an amount of Mn of the steel constituents of the part core which was insufficient and had a total amount of elements for improving hardenability which was small, so hardenability could not be secured, incompletely hardened structures were formed, and the surface hardness failed to reach the target. As a result, the rotating bending fatigue limit failed to reach the target.

Manufacturing No. 16 had an amount of Mn of the steel constituents of the part core which was excessive and had a core hardness outside the target range. Due to the rise in core hardness, the toughness of the steel deteriorated. As a result, the rotating bending fatigue limit failed to reach the target.

Manufacturing No. 17 had an amount of Cr of the steel constituents of the part core which was insufficient. Along with diffusion of carbon to the inside of the steel material in the diffusion period, the amount of carbon at the surface layer of the steel material fell. Due to this, the surface hardness failed to reach the target. As a result, the rotating bending fatigue limit failed to reach the target.

Manufacturing No. 18 had an amount of Cr of the steel constituents of the part core which was excessive. After the end of the diffusion period, grain boundary cementite and incompletely hardened structures excessively remained. As a result, the rotating bending fatigue limit failed to reach the target.

Manufacturing No. 19 had an amount of Al of the steel constituents of the part core which was excessive. Coarse oxides remained. Therefore, the rotating bending fatigue limit failed to reach the target.

Manufacturing No. 20 had an amount of N of the steel constituents of the part core which was insufficient. Coarsening of the crystal grains in the austenite region could not be suppressed. As a result, the rotating bending fatigue limit failed to reach the target.

Manufacturing No. 21 had an amount of N of the steel constituents of the part core which was excessive. Coarse AlN was formed. Coarsening of the crystal grains in the austenite region could not be suppressed. As a result, the rotating bending fatigue limit failed to reach the target.

Manufacturing No. 22 had an amount of S of the steel constituents of the part core which was excessive. MnS acted as paths for propagation of fatigue cracks. As a result, the rotating bending fatigue limit failed to reach the target.

Manufacturing No. 23 performed gas carburizing, so incompletely hardened structures were formed at the part surface and these became starting points for fracture at the time of a fatigue test. Therefore, the rotating bending fatigue limit failed to reach the target.

Manufacturing No. 24 had a temperature at the time of vacuum carburizing which was higher than 1100° C., so remarkable grain coarsening occurred, further, diffusion of carbon was promoted, the concentration of carbon at the surface layer became excessively high, and the grain boundary cementite fraction and incompletely hardened structures failed to reach the targets. As a result, the rotating bending fatigue limit failed to reach the target.

Manufacturing No. 25 had a carburizing time of shorter than 10 minutes, so the content of C at the surface layer became insufficient and the surface hardness failed to reach the target. As a result, the rotating bending fatigue limit failed to reach the target.

Manufacturing No. 26 had a carburizing time of longer than 200 minutes, so the concentration of carbon at the surface layer became excessively high and the grain boundary cementite fraction and incompletely hardened structures failed to reach the targets. As a result, the rotating bending fatigue limit failed to reach the target.

Manufacturing No. 27 had a diffusion time of shorter than 15 minutes, so the grain boundary cementite precipitated on the prior austenite grain boundaries was not sufficiently broken down and the grain boundary cementite fraction and incompletely hardened structures failed to reach the targets. As a result, the rotating bending fatigue limit failed to reach the target.

Manufacturing No. 28 had a cooling rate of less than 5° C./s. Grain boundary cementite precipitated during cooling whereby the grain boundary cementite fraction and incompletely hardened structures failed to reach the targets. As a result, the rotating bending fatigue limit failed to reach the target.

Manufacturing No. 29 had a diffusion time of longer than 300 minutes, so along with the diffusion of carbon to the inside of the steel material in the diffusion period, the amount of carbon at the surface layer of the part fell and thereby the surface hardness failed to reach the target. As a result, the rotating bending fatigue limit failed to reach the target.

Manufacturing No. 30 had an amount of Al of the steel constituents of the part core which was insufficient. Coarsening of the crystal grains in the austenite region could not be suppressed. As a result, the rotating bending fatigue limit failed to reach the target.

INDUSTRIAL APPLICABILITY

Due to the above, in the vacuum carburized part of the present invention, compared with conventional parts, the grain boundary cementite fraction and incompletely hardened structures at the flat parts are smaller, so the bending fatigue strength of the part can be improved.

The invention claimed is:

1. A carburized part, a chemical composition in a region of a depth of 1.5 mm or more from a surface of the carburized part containing, by mass %, C: 0.10 to 0.40%,
Si: 0.10 to 3.00%,
Mn: 0.50 to 3.00%,
Cr: 0.30 to 3.00%,
Al: 0.010 to 0.050%,
N: 0.003 to 0.030%,
S: 0.003 to 0.030%,
P: 0.030% or less,
Mo: 0 to 3.00%,
B: 0 to 0.0050%,
Nb: 0 to 0.100%,
Ti: 0 to 0.100%,
V: 0 to 0.30%, Ni: 0 to 0.40%,
In: 0 to 0.02%,
Cu: 0 to 0.20%,
Bi: 0 to 0.300%,
Pb: 0 to 0.50%,
REMs: 0 to 0.020% and
a balance of Fe and impurities;
a Vickers hardness at a depth of 1.5 mm from the surface being 200 to 400 HV;
a content of C at a region of a depth down to 0.10 mm from the surface being, by mass %, 0.60 to 1.20%;
a fraction of hardened structures of an area ratio being 99.00% or more;
a grain boundary cementite fraction of an area ratio being 0.50% or less;
a fraction of incompletely hardened structures of an area ratio being 0.50% or less.

2. The carburized part of claim 1 wherein a Vickers hardness of a depth of 0.10 mm from the surface is 700 HV or more.

3. A method of manufacture for manufacturing the carburized part of claim 1 comprising the steps of:

shaping into the shape of a machine part a steel material having a chemical composition in a region of a depth of 1.5 mm or more from the surface as described in claim 1,
vacuum carburizing the shaped steel material,
cooling the vacuum carburized steel material by a cooling rate of 10° C./s or more from a temperature region of 850° C. or more until reaching 200° C., and
tempering the cooled steel material at 130 to 200° C.;
the process of vacuum carburizing comprising
a carburizing period of holding the steel material at 850 to 1100° C. for 10 to 200 minutes and causing carbon to penetrate it in a carburizing gas atmosphere and
a diffusion period of stopping the supply of carburizing gas and holding the steel material at
(a) 850 to 970° C. for 50 to 300 minutes or
(b) over 970 to 1100° C. for 15 to 300 minutes.

4. The method for manufacture of the carburized part of claim 3 further comprising, in the carburizing period, holding the steel material in a carburizing gas atmosphere at
(c) 850 to 970° C. for 50 to 200 minutes or
(d) over 970 to 1100° C. for 10 to 200 minutes.

* * * * *